US007915206B2

(12) United States Patent
Morrison et al.

(10) Patent No.: US 7,915,206 B2
(45) **Date of Patent: *Mar. 29, 2011**

(54) SILICONE LUBRICANT WITH GOOD WETTING ON PET SURFACES

(75) Inventors: Eric D. Morrison, West St. Paul, MN (US); Richard D. Johnson, St. Paul, MN (US); Michael E. Besse, Golden Valley, MN (US); Victor Fuk-Pong Man, St. Paul, MN (US)

(73) Assignee: Ecolab, St. Paul, MN (US)

( * ) Notice: Subject to any disclaimer, the term of this patent is extended or adjusted under 35 U.S.C. 154(b) by 1093 days.

This patent is subject to a terminal disclaimer.

(21) Appl. No.: 11/233,596

(22) Filed: Sep. 22, 2005

(65) Prior Publication Data

US 2007/0066497 A1 Mar. 22, 2007

(51) Int. Cl.
*C10M 173/02* (2006.01)
*C10M 155/02* (2006.01)

(52) U.S. Cl. ..... 508/208; 508/209

(58) Field of Classification Search ..... 508/110, 508/136, 181, 183, 579, 583, 582, 590, 591, 508/202–208, 465, 470, 545, 209
See application file for complete search history.

(56) References Cited

U.S. PATENT DOCUMENTS

| | | | |
|---|---|---|---|
| 3,011,975 | A | 12/1961 | Nitzsche |
| 3,213,024 | A | 10/1965 | Blake |
| 3,514,314 | A | 5/1970 | Nemeth |
| 3,664,956 | A | 5/1972 | Messina |
| 3,853,607 | A | 12/1974 | Iyengar |
| 3,981,812 | A | 9/1976 | Zietz |
| 4,062,785 | A | 12/1977 | Nibert |
| 4,065,590 | A | 12/1977 | Salensky |
| 4,069,933 | A | 1/1978 | Newing |
| 4,083,791 | A | 4/1978 | Elliott |
| 4,105,716 | A | 8/1978 | Sakai |
| 4,132,657 | A | 1/1979 | Verdicchio |
| 4,149,624 | A | 4/1979 | Douty |
| 4,162,347 | A | 7/1979 | Montgomery |
| 4,165,291 | A | 8/1979 | Gragson |
| 4,225,450 | A | 9/1980 | Rosenberger |
| 4,248,724 | A | 2/1981 | MacIntosh |
| 4,252,528 | A | 2/1981 | Decker |
| 4,262,776 | A | 4/1981 | Wilson |
| 4,264,650 | A | 4/1981 | Schulze |
| 4,274,973 | A | 6/1981 | Stanton |
| 4,289,671 | A | 9/1981 | Hernandez |
| 4,324,671 | A | 4/1982 | Christian |
| 4,343,616 | A | 8/1982 | Decker |
| 4,375,444 | A | 3/1983 | Deeken |
| 4,420,578 | A | 12/1983 | Hagens |
| 4,436,200 | A | 3/1984 | Hodlewsky |
| 4,478,889 | A | 10/1984 | Maruhashi |
| 4,486,378 | A | 12/1984 | Hirata |
| 4,515,836 | A | 5/1985 | Cobbs, Jr. |
| 4,525,377 | A | 6/1985 | Nickel |
| 4,534,995 | A | 8/1985 | Pocock |
| 4,538,542 | A | 9/1985 | Kennon |
| 4,543,909 | A | 10/1985 | Sharpless |
| 4,555,543 | A | 11/1985 | Effenberger |
| 4,569,869 | A | 2/1986 | Kushida |
| 4,573,429 | A | 3/1986 | Cobbs, Jr. |
| 4,604,220 | A | 8/1986 | Stanton |
| 4,632,053 | A | 12/1986 | Villanueva |
| 4,690,299 | A | 9/1987 | Cannon |
| 4,699,809 | A | 10/1987 | Maruhashi |
| 4,713,266 | A | 12/1987 | Hasegawa |
| 4,714,580 | A | 12/1987 | Maruhashi |
| 4,719,022 | A | 1/1988 | Hyde |
| 4,769,162 | A | 9/1988 | Remus |
| 4,828,727 | A | 5/1989 | McAninch |
| 4,851,287 | A | 7/1989 | Hartsing, Jr. |
| 4,855,162 | A | 8/1989 | Wrasidlo |
| 4,867,890 | A | 9/1989 | Colclough |
| 4,874,647 | A | 10/1989 | Yatsu |
| 4,919,984 | A | 4/1990 | Maruhashi |
| 4,929,375 | A | 5/1990 | Rossio |
| 4,980,211 | A | 12/1990 | Kushida |
| 4,995,993 | A | 2/1991 | Papke |
| 5,001,935 | A | 3/1991 | Tekkanat |
| 5,009,801 | A | 4/1991 | Wider |
| 5,032,301 | A | 7/1991 | Pawloski |
| 5,073,280 | A | 12/1991 | Rossio |
| 5,104,559 | A | 4/1992 | Pawloski |
| 5,115,047 | A | 5/1992 | Hashimoto |
| 5,145,721 | A | 9/1992 | Kojima |

(Continued)

FOREIGN PATENT DOCUMENTS

| | | |
|---|---|---|
| CA | 1157456 | 11/1983 |

(Continued)

OTHER PUBLICATIONS

U.S. Appl. No. 60/149,095, filed Aug. 16, 1999, Hei.
U.S. Appl. No. 60/149,048, filed Aug. 16, 1999, Hei.
U.S. Appl. No. 09/619,261, filed Jul. 19, 2000, Corby.
U.S. Appl. No. 60/230,662, filed Sep. 7, 2000, Bennett.
International Search Report of EP03076178 dated Jun. 12, 2003, 2 pgs.
European Search Report of EP03076177 dated Jul. 17, 2003, 2 pgs.
Dupont, "Krytox® Dry Film Lubricants", Nov. 1997, 6 pgs.
Ecolab, "Lube Application to Conveyor Surface/Containers", Jun. 13, 2000, 7 pgs.
Interflon, "Fin Food Lube AL. High Penetration Teflon® Lubricating Agent Especially Suitable for Automatic Lubrication Systems for the Food Processing Industry", 1998, 20 pgs.

(Continued)

*Primary Examiner* — Ellen M McAvoy
*Assistant Examiner* — Pamela Weiss
(74) *Attorney, Agent, or Firm* — Merchant & Gould P.C.

(57) ABSTRACT

The passage of a container along a conveyor is lubricated by applying to the container or conveyor a composition comprising a water-miscible silicone material wherein the composition has good wetting to polyethylene terephthalate surfaces. The compatibility of the lubricating composition with polyethylene terephthalate is increased because the wetting of the composition to polyethylene terephthalate is improved.

28 Claims, No Drawings

U.S. PATENT DOCUMENTS

| | | | | |
|---|---|---|---|---|
| 5,160,646 | A | 11/1992 | Scheld | |
| 5,174,914 | A | 12/1992 | Gutzmann | |
| 5,182,035 | A | 1/1993 | Schmidt | |
| 5,202,037 | A | 4/1993 | Lavelle | |
| 5,238,718 | A | 8/1993 | Yano | |
| 5,244,589 | A | 9/1993 | Liu | |
| 5,317,061 | A | 5/1994 | Chu | |
| 5,334,322 | A | 8/1994 | Williams, Jr. | |
| RE34,742 | E | 9/1994 | Maier | |
| 5,352,376 | A | 10/1994 | Gutzmann | |
| 5,371,112 | A | 12/1994 | Sayre | |
| 5,391,308 | A | 2/1995 | Despo | |
| 5,411,672 | A | 5/1995 | Kagaya | |
| 5,509,965 | A | 4/1996 | Harry | |
| 5,510,045 | A | 4/1996 | Remus | |
| 5,559,087 | A | 9/1996 | Halsrud | |
| 5,565,127 | A | 10/1996 | Laufenberg | |
| 5,573,819 | A | 11/1996 | Nugent, Jr. | |
| 5,652,034 | A | 7/1997 | Seiner | |
| 5,658,619 | A | 8/1997 | Kirschner | |
| 5,663,131 | A | 9/1997 | Winicov | |
| 5,670,463 | A | 9/1997 | Maples | |
| 5,672,401 | A | 9/1997 | Anglin | |
| 5,681,628 | A | 10/1997 | Niederst | |
| 5,698,269 | A | 12/1997 | Carlblom | |
| 5,721,023 | A | 2/1998 | Ostapchenko | |
| 5,723,418 | A | 3/1998 | Person Hei | |
| 5,728,770 | A | 3/1998 | Yamamoto | |
| 5,747,431 | A | 5/1998 | Taylour | |
| 5,783,303 | A | 7/1998 | Tsuei | |
| 5,789,459 | A | 8/1998 | Inagaki | |
| 5,863,874 | A | 1/1999 | Person Hei | |
| 5,871,590 | A | 2/1999 | Hei | |
| 5,876,812 | A | 3/1999 | Frisk | |
| 5,925,601 | A | 7/1999 | McSherry | |
| 5,932,526 | A | 8/1999 | Person Hei | |
| 5,935,914 | A | 8/1999 | Theyssen | |
| 5,952,601 | A | 9/1999 | Sanford | |
| 6,060,444 | A | 5/2000 | Schulz | |
| 6,087,308 | A | 7/2000 | Butler | |
| 6,096,692 | A | 8/2000 | Hagihara | |
| 6,177,036 | B1 * | 1/2001 | Van Der Hoeven et al. | 264/45.9 |
| 6,207,622 | B1 | 3/2001 | Li | |
| 6,214,777 | B1 | 4/2001 | Li | |
| 6,288,012 | B1 | 9/2001 | Li | |
| 6,372,698 | B1 | 4/2002 | Strothoff | |
| 6,427,826 | B1 | 8/2002 | Li | |
| 6,495,494 | B1 | 12/2002 | Li | |
| 6,509,302 | B2 | 1/2003 | Li | |
| 6,541,430 | B1 | 4/2003 | Beatty | |
| 6,569,816 | B2 | 5/2003 | Oohira | |
| 6,576,298 | B2 | 6/2003 | Bennett | |
| 6,653,263 | B1 | 11/2003 | Küpper | |
| 6,673,753 | B2 * | 1/2004 | Person Hei et al. | 508/208 |
| 6,677,280 | B2 | 1/2004 | Küpper | |
| 6,688,434 | B2 | 2/2004 | Johnson | |
| 6,696,394 | B1 | 2/2004 | Ruhr | |
| 6,743,758 | B2 | 6/2004 | Li | |
| 6,780,823 | B2 | 8/2004 | Li | |
| 6,806,240 | B1 | 10/2004 | Hei | |
| 6,809,068 | B1 | 10/2004 | Küpper | |
| 6,821,568 | B2 | 11/2004 | Bennett | |
| 6,855,676 | B2 | 2/2005 | Li | |
| 2001/0003733 | A1 * | 6/2001 | Kupper et al. | 508/181 |
| 2002/0025912 | A1 | 2/2002 | Person Hei et al. | |
| 2003/0073589 | A1 | 4/2003 | Li | |
| 2004/0029741 | A1 | 2/2004 | Corby | |
| 2004/0058829 | A1 | 3/2004 | Hei | |
| 2004/0077776 | A1 * | 4/2004 | Feng et al. | 524/588 |
| 2004/0097382 | A1 | 5/2004 | Li | |
| 2004/0102337 | A1 | 5/2004 | Li | |
| 2004/0235680 | A1 | 11/2004 | Lawrence | |

FOREIGN PATENT DOCUMENTS

| | | |
|---|---|---|
| DE | 19942535 | 3/2001 |
| EP | 0359330 | 3/1990 |
| EP | 0844299 | 5/1998 |
| GB | 1564128 | 4/1980 |
| JP | 57003892 | 1/1982 |
| JP | 6136377 | 5/1994 |
| JP | 7247293 | 9/1995 |
| JP | 7268380 | 10/1995 |
| JP | 10053679 | 2/1998 |
| JP | 10059523 | 3/1998 |
| JP | 2004217866 | 8/2004 |
| NL | 9300742 | 12/1993 |
| WO | WO96/08601 | 3/1996 |
| WO | WO98/51746 | 11/1998 |
| WO | WO01/07544 | 2/2001 |
| WO | WO01/12759 | 2/2001 |
| WO | WO02/20381 | 3/2002 |
| WO | WO03078557 | 9/2003 |
| WO | WO 03099984 A1 * | 12/2003 |
| WO | WO2006/009421 | 1/2006 |
| WO | WO2006/017503 | 2/2006 |
| WO | WO2007/040677 | 4/2007 |
| WO | WO2007/040678 | 4/2007 |

OTHER PUBLICATIONS

Interflon, "Maintenance Products with Teflon®", http://www.interflon.nl/engels.htm, Jun. 18, 1999, 10 pgs.

Moskala, E., "Environmental Stress Cracking in PET Beverage Containers", BEV-PAK Americas '96, Apr. 15-16, 1996, 14 pgs.

Moskala, E., "Environmental Stress Cracking in PET Carbonated Soft Drink Containers", Bev Tech 98, Mar. 30-Apr. 1, 1998, 22 pgs.

SYNCO Chemical Corporation, "Other Super Lube Products . . . What is Super Lube®?" http://www.super-lube.com, May 5, 1999, 5 pgs.

Tekkanat, B. et al., "Environmental Stress Cracking Resistance of Blow Molded Poly(Ethylene Terephthalate) Containers", Polymer Engineering and Science, vol. 32, No. 6, Mar. 1992, pp. 393-397, 5 pgs.

U.S. Appl. No. 11/233,596, filed Sep. 22, 2005, Morrison.

*DOW CORNING Emulsion* [*Online*] 1998, XP002463027, URL: http://www2.dowcorning.com/DataFiles/090007c880001bdc.pdf, Dec. 19, 2007, 2 pages.

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.

Gorton, Hugh J. Ph.D. and Taylour, Jim M. PhD. C Chem, "*The Development of New Conveyor Lubricant Technology*", MBAA Technical Quarterly, vol. 30, pp. 18-22, 1993, 5 pages.

US 5,863,871, 01/1999, Besse (withdrawn)

* cited by examiner

SILICONE LUBRICANT WITH GOOD WETTING ON PET SURFACES

FIELD OF THE INVENTION

This invention relates to conveyor lubricants and to a method for conveying articles. The invention also relates to conveyor systems and containers wholly or partially coated with such lubricant compositions.

BACKGROUND

In commercial container filling or packaging operations, the containers typically are moved by a conveying system at very high rates of speed. Dilute aqueous lubricant compositions are typically applied to the conveyor or containers using spray or pumping equipment. These lubricant compositions permit high-speed operation of the conveyor and limit marring of the containers or labels. One problem that can occur with thermoplastic beverage containers made from polyethylene terephthalate (PET) is environmental stress cracking. Stress cracking in polymers is the development of cracks normal to an applied stress as a result of stress promoted chemical degradation. Typically amorphous polymers are more susceptible to stress cracking. In the case of PET, it is the amorphous regions of a beverage container such as the center of the base of a PET bottle that are most susceptible to stress cracking. When stress cracks penetrate through the wall of a PET bottle, the bottle fails either by leaking or bursting. Because of environmental stress cracking, bottles filled with carbonated drinks are at risk for failure, especially at elevated temperatures (e.g., warmer weather, elevated storage temperatures, etc.). The risk of environmental stress cracking is exacerbated by the presence of materials which are incompatible with PET. Materials that, when in contact with PET increase the rate of occurrence of environmental stress cracking are considered incompatible with PET while materials that result in no increase in environmental stress cracking are considered compatible with PET. The failure rate of PET bottles is greater for bottles that have been contacted with alkaline water than for bottles that have been contacted with deionized water, thus it can be stated that the presence of alkalinity decreases the compatibility of aqueous compositions with PET bottles.

It is often the case that water used in the preparation of conveyor lubricant compositions contains alkalinity. For example, the alkalinity of water used for dilution of conveyor lubricants in bottling plants typically ranges between about 10 ppm and 100 ppm, expressed as ppm of $CaCO_3$ (calcium carbonate), with occasional values above 100 ppm. According to the International Society of Beverage Technologists web site, it is strongly recommended to keep the total alkalinity level (expressed as $CaCO_3$) below 50 mg/L (equivalent to 50 ppm as $CaCO_3$) in the water used to dilute lubricant concentrate compositions (lube make up water) in order to minimize the risk of stress crack failure. It is therefore important for conveyor lubricant compositions to show good compatibility with PET beverage bottles in the case that the dilution water contains alkalinity, particularly in the case that the dilution water exhibits alkalinity levels above 50 ppm and up to and in excess of 100 ppm, measured as $CaCO_3$.

Silicone based lubricants are preferred lubricants for PET bottles because they provide improved lubrication properties and significantly increased conveyor efficiency. Silicone containing lubricant compositions are described, for example in U.S. Pat. No. 6,495,494 (Li et. al) which is incorporated by reference herein in its entirety. However, aqueous silicone based lubricants may be considered to be less compatible with PET than other types of lubricants such as phosphate ester based lubricants. For example, conventional aqueous silicone lubricant compositions generally show a relatively higher incidence of stress cracking under conditions of high alkalinity. There has therefore been an unmet need in the field of conveyor lubrication which is an aqueous silicone conveyor lubricant that exhibits good compatibility with PET, particularly in the case that the lubricant contains alkalinity, for example from the dilution water.

It is against this background that the present invention has been made.

SUMMARY OF THE INVENTION

Surprisingly, it has been discovered that a silicone based lubricant with improved wetting characteristics increases the compatibility of the silicone based lubricant with PET. Accordingly, the present invention provides, in one aspect, a method for lubricating the passage of a container along a conveyor comprising applying a composition of a water-miscible silicone material to at least a portion of the container contacting surface of the conveyor or to at least a portion of the conveyor-contacting surface of the container, wherein the contact angle between the lubricant composition and container is less than about 60 degrees. The present invention provides, in another aspect, a method for lubricating the passage of a container along a conveyor comprising applying a composition of a water-miscible silicone material to at least a portion of the container contacting surface of the conveyor or to at least a portion of the conveyor-contacting surface of the container, wherein the lubricant forms a substantially contiguous coating which covers greater than about 30% of the surface when coated and dried onto polyethylene terephthalate film with a wet coating thickness of about 14 microns. The present invention provides, in another aspect, a method for lubricating the passage of a container along a conveyor comprising applying a composition of a water-miscible silicone material to at least a portion of the container contacting surface of the conveyor or to at least a portion of the conveyor-contacting surface of the container, wherein the lubricant composition has a foam profile of greater than about 1.1. The invention also provides conveyor lubricant compositions comprising a water-miscible silicone material and a wetting agent present in an amount effective to provide a contact angle of less than 60 degrees between the lubricant composition and a container surface. The present invention provides, in another aspect, a lubricant concentrate composition comprising a water-miscible silicone material and a wetting agent present in an amount effective to provide a contact angle of less than 60 degrees between the diluted lubricant composition and a container surface when one part of the lubricant concentrate is diluted with between 100 and 1000 parts of water and/or hydrophilic diluent. These and other aspects of this invention will be evident upon reference to the following detailed description of the invention.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt. %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

The invention provides a lubricant coating that reduces the coefficient of friction of coated conveyor parts and containers and thereby facilitates movement of containers along a conveyor line. The present invention provides in one aspect, a method for lubricating the passage of a container along a conveyor comprising applying a composition of a water-miscible silicone material to at least a portion of the container contacting surface of the conveyor or to at least a portion of the conveyor-contacting surface of the container, wherein the composition exhibits good wetting to PET. Typically lubricant compositions according to the present invention will contain in addition to the water-miscible silicone material an agent or agents for the improvement of the wetting of the composition to PET. Lubricant compositions of the present invention may also include, in addition to silicone and wetting agents, water-miscible lubricants that do not significantly improve the wetting of the lubricant to PET.

It has been found, surprisingly, that the "compatibility" with PET of conveyor lubricant compositions containing silicone can be significantly improved by improving the wetting of the lubricant composition to the PET surface. That is, PET beverage bottles which have been contacted with a silicone conveyor lubricant composition which has good wetting to PET show a lower bottle failure rate upon storage in a hot and humid environment than a similar silicone conveyor lubricant composition which has poor wetting to PET. Prior art silicone conveyor lubricant compositions exhibit poor wetting on PET surfaces. The use of these products in the situation of alkalinity and high temperature and humidity poses a risk for environmental stress cracking of PET bottles.

The wetting behavior of lubricant compositions can be observed by preparing a coating of the lubricant composition onto PET film. By this method, a puddle of lubricant composition is spread across the film surface using a wire wound bar in an action that is referred to as "drawing down" or "hand-spreading." The thickness of the wet coating prepared by hand spreading is determined by the gauge thickness of the wire wound on the bar. As the thickness of the wire increases, so do the sizes of gaps between wire wraps and so does the thickness of the resulting coating. For example, a bar wrapped with 150 micron diameter wire will deposit a coating approximately 14 microns thick and a bar wrapped with 300 micron diameter wire will deposit a coating approximately 27 microns thick under similar conditions. Once the coating has been prepared by handspreading, the stability of the coating is dependent upon the wetting behavior. Coating compositions that have poor wetting are observed to de-wet the surface instantly, beading up to give isolated droplets of the coating composition. Coating compositions that have good wetting remain as contiguous, substantially uninterrupted films without showing a tendency to de-wet the surface or to bead up. Coating compositions that have intermediate wetting properties typically give contiguous films which may have imperfections including de-wet spots and areas of non-uniform thickness.

The wetting behavior of lubricant compositions can be quantified by measuring the contact angle of the lubricant composition with PET. It is well known to characterize the wetting behavior of liquids on solids by measuring the contact angle.

The lower the contact angle between a liquid and a solid, the better a liquid will wet the surface of the solid. The contact angle θ of a liquid on a solid is dependent upon the solid-liquid interfacial tension $\gamma_{SL}$, the solid-vapor interfacial tension $\gamma_{SV}$ ("surface energy of solid"), and the liquid-vapor interfacial tension $\gamma_{LV}$ ("surface tension of a liquid") by the well known Young's equation:

$$\cos\theta=(\gamma_{SV}-\gamma_{SL})/\gamma_{LV}$$

The contact angle is smaller as cos θ increases. Therefore from Young's equation best wetting is achieved by making $\gamma_{SL}$ and $\gamma_{LV}$ as small as possible. This can be accomplished by use of wetting agents. For the special case of conveyor lubricant compatibility with polyethylene terephthalate, $\gamma_{SV}$ is a property of polyethylene terephthalate and is not changeable by modifying the properties of the lubricant composition. It might be thought that it is effective merely to achieve a much lower the surface tension ($\gamma_{LV}$) of the lubricant composition, and that addition of any surfactant that is capable to lower the surface tension would be sufficient to improve the wetting of the lubricant composition to the polymer surface. Actually it is equally if not more important that the wetting agent lower the interfacial energy between the polymer surface and the liquid lubricant composition ($\gamma_{SL}$). Lowering the interfacial energy between the polyethylene terephthalate surface and the liquid lubricant composition may also diminish the reactivity of the polymer with water in the hydrolysis reaction, and increase the degree of crazing. According to Volynskii (Volynskii, A. L., & Bakeev, N. F. (1995). *Solvent Crazing of Polymers, Studies in Polymer Science* 13. New York, N.Y.: Elsevier), solvent crazing of polymers under stress results from suppression of the coagulation of oriented polymer fibrils due to the presence of surface active liquid environments. The surface activity of the liquid environment increases as $\gamma_{SL}$ decreases. Whether for the benefit of improving the wetting and the areal coverage of the lubricant composition as it dries, increasing the surface activity of the lubricant composition with respect to the polymer surface, or to promote crazing, it is believed important to select wetting agents on the basis of lowering the contact angle between the lubricant composition and the polymer surface rather than simply on the basis of lowering the surface tension of the liquid lubricant composition.

The contact angle is typically measured by recording an image of a test liquid on the surface of the test solid, then measuring the intersecting angle between the liquid-air interface and the liquid-solid interface.

While we do not wish to be bound by theory, there are several possible explanations for why improving the wetting of silicone lubricants improves the compatibility with PET. The simplest explanation is that by preventing the lubricant composition from beading up, the feature of good wetting is preventing the concentration of alkaline residue, for example in water spots. By distributing alkaline compounds evenly across the bottle, the better wetting lubricant compositions are preventing localized attack of concentrated alkaline species.

Another possible reason for the lowering of burst rates with better wetting lubricant compositions is that surface active agents in the lubricant stabilize the polymer against chemical attack. When filled bottles expand under pressure in a process commonly referred to as "creep," virgin, previously unexposed polymer surface is created. By stabilizing the newly generated surface area, the reaction of the polymer in those areas with water in the ester hydrolysis reaction may be reduced.

The lowering of burst rates may also be related to the development of microscopic crazes on the surface of the bottle. Typically, as the wetting behavior of lubricants on PET improves, the amount of crazing increases. The presence of crazes in the amorphous PET regions of the bottle may mitigate macroscopic cracking and failure by either dissipating the attack of alkaline hydrolysis or by making more tortuous the path of a propagating crack tip. When tested on carbonated beverage bottles in a stress test at 100 F and 85% relative humidity, inventive lubricant compositions showed relatively more crazing than either deionized water or comparative example formulations. Using a visual crazing test where bottles with no visible signs of crazing are scored 0 and bottles with pronounced crazing are scored 10, lubricant compositions of the present invention typically gave crazing values above about 4, compared to water and comparative example compositions which gave crazing values less than about 4.

Regardless of the mechanism, the present invention has been observed to reduce stress cracking in PET bottles when compared to prior art compositions, based on the wetting properties of the invention. The wetting properties can be measured in a variety of ways including contact angle and by coating the compositions onto PET sheets. The contact angles of compositions of the present invention with PET are generally below about 60 degrees, while the contact angles of prior art and comparative compositions are above 60 degrees. Accordingly, compositions of the present invention having improved wetting properties have contact angles below about 60 degrees, below about 50 degrees, or below about 40 degrees. When coated as a thin film onto PET sheets and dried, inventive lubricant compositions cover greater than about 30% of the PET surface area that was originally wetted in the coating process, while prior art and comparative examples generally cover less than 10% of the originally wetted surface. Accordingly, when coated as a thin film onto PET sheets and dried, compositions of the present invention cover greater than about 30%, greater than about 50%, or greater than about 70% of the PET surface area that was originally wetted in the coating process.

Inventive lubricant compositions also give relatively more foam than either deionized water or comparative example formulations. Using a foam profile test where the foam profile measured 60 seconds after ten inversions of a graduated cylinder is the ratio of the volume of liquid plus foam to liquid originally present, inventive compositions gave foam profile values greater than about 1.1 compared to prior art and comparative example compositions which generally gave foam profile values less than 1.1. Accordingly, when evaluated using a foam profile test where the foam profile measured 60 seconds after ten inversions of a graduated cylinder is the ratio of the volume of liquid, compositions of the present invention give foam profile values greater than about 1.1, greater than about 1.3, or greater than about 1.5.

Lubricant compositions of the present invention comprise wetting agents in amounts sufficient to impart good wetting properties of the composition to PET. Accordingly, compositions of the present invention have greater than about 0.01 wt. % of wetting agent, greater than about 0.02 wt. % wetting agent, or greater than about 0.04 wt. % wetting agent.

It may be desirable to provide compositions of the present invention in the form of concentrates that can be diluted with water at the point of use to give use compositions. Inventive lubricant concentrate compositions comprise a water-miscible silicone material and a wetting agent present in an amount effective to provide a contact angle of less than 60 degrees between the diluted lubricant composition and a container surface when one part of the lubricant concentrate is diluted with between 100 and 1000 parts of water plus hydrophilic diluent. Accordingly, lubricant concentrate compositions comprise greater than about 1.0 wt. % of wetting agent, greater than about 2.0 wt. % wetting agent, or greater than about 4.0 wt. % wetting agent.

The wetting behavior of lubricants is relevant to the lubricant as it is applied, either to the PET bottle directly or to any other surface where it may come in contact with PET bottles, including the conveyor belt. This includes lubricants which consist of a lubricant concentrate that is diluted with water at the point of use in any ratio of lubricant concentrate to water, and it includes lubricants which are applied without dilution.

The silicone material and wetting agents are "water-miscible", that is, they are sufficiently water-soluble or water-dispersible so that when added to water at the desired use level they form a stable solution, emulsion, or suspension. The desired use level will vary according to the particular conveyor or container application, and according to the type of silicone and wetting agent employed.

A variety of water-miscible silicone materials can be employed in the lubricant compositions, including one or more of the group consisting of silicone emulsions (such as emulsions formed from methyl(dimethyl), higher alkyl and aryl silicones; and functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E2140 polydimethylsiloxane (a 35% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones). Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.).

Polydimethylsiloxane emulsions are preferred silicone materials. Generally the concentration of the active silicone material useful in the present invention exclusive of any dispersing agents, water, diluents, or other ingredients used to emulsify the silicone material or otherwise make it miscible with water falls in the range of about 0.0005% to about 5.0%, about 0.001% to about 1.0%, or about 0.002% to about 0.50%. In the case that the lubricant composition is provided in the form of a concentrate, the concentration of active silicone material useful in the present invention exclusive of any dispersing agents, water, diluents, or other ingredients used to emulsify the silicone material or otherwise make it miscible with water falls in the range of about 0.05% to about 20%, about 0.10% to about 5%, or about 0.2% to about 1.0%.

As used herein, a wetting agent is a surface active agent or a mixture of one or more surface active agents that imparts good wetting when added to a lubricant composition. By good wetting it is meant the contact angle between the lubricant composition and PET is below about 60 degrees or increases the areal coverage of the lubricant concentration upon coating and drying on PET film is greater than about 30%. The wetting agent or wetting admixture of wetting agents of the present invention can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, and foam control.

Generally, the concentration of wetting agent or wetting agent mixture useful in lubricant use compositions of the present invention fall in the range of from about 0.01% to about 0.5 wt. % of the wetting agent or agents, by weight of the composition, about 0.02% to about 0.30 wt. % of the wetting agent, or about 0.04% to about 0.15 wt. % of the wetting agent. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical. In the case that the lubricant composition is provided in the form of a concentrate, the concentration of wetting agent or wetting agent mixture useful in the concentrate compositions of the present invention fall in the range of from about 1% to about 50% of the wetting agent or agents, by weight of the composition, about 2% to about 30% of the wetting agent, or about 4% to about 20 wt. % of the wetting agent.

Nonionic Surfactant Wetting Agents

Nonionic surfactant wetting agents useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its compositions with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

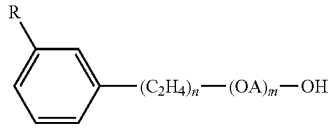

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$, wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycidyl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or —$(C_2H_4O)_nH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae:

$R^{20}$—$(PO)_sN$-$(EO)_tH$, $R^{20}$—$(PO)_sN$-$(EO)_tH(EO)_tH$, and $R^{20}$—$N(EO)_tH$;

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactant Wetting Agents

The semi-polar type of nonionic surface active agents are another class of nonionic surfactant useful in compositions of the present invention. Generally, semi-polar nonionics are high foamers and foam stabilizers, which can limit their application in conveyor lubricant compositions. However, within compositional embodiments of this invention designed for high foam applications, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

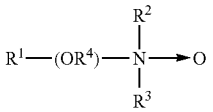

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl)amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

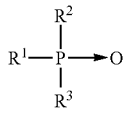

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Semi-polar nonionic surfactants useful herein also include the water soluble sulfoxide compounds which have the structure:

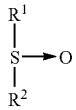

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like.

Anionic Surfactant Wetting Agents

Also useful in the present invention are surface active substances which are categorized as anionics because the charge on the hydrophobe is negative. Carboxylate, sulfonate, sulfate and phosphate are the polar (hydrophilic) solubilizing groups found in anionic surfactants. Preferred anionic surfactant wetting agents are those in which the hydrophobic section of the molecule carries a charge at pH values at neutrality or below, less preferred are those in which the hydrophobic section of the molecule carries no charge unless the pH is elevated to neutrality or above (e.g. carboxylic acids). Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore, favored additions to give lubricant compositions which provide improved detergency. Generally, however, anionics have high foam profiles which limit their use alone or at high concentration levels in conveyor lubricants where low foam profiles are preferred. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia", *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic surfactant compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Other anionic surfactants suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Care should be taken to avoid the use of wetting agents that might promote environmental stress cracking in plastic containers when evaluated using the PET Stress Crack Test set out below. The tendency of wetting agents to promote environmental stress cracking can be evaluated using the PET Stress Crack Test set out below. Examples of preferred wetting agents include fatty amines, alcohol ethoxylates and mixtures thereof. Examples of particularly preferred lubricant use compositions include those having from about 0.001 wt. % to about 0.02 wt. % of a water-miscible silicone material from about 0.01 wt. % to about 0.05 wt. % of a fatty amine compound, and from about 0.02 wt. % to about 0.10 wt. % of an alcohol ethoxylate compound. Examples of particularly preferred lubricant concentrate compositions include those having from about 0.10 wt. % to about 2 wt. % of a water-miscible silicone material from about 1.0 wt. % to about 20 wt. % of fatty amine compound, and from about 2 wt. % to about 40 wt. % of an alcohol ethoxylate compound. Particularly preferred lubricant compositions are substantially aqueous, that is, they comprise greater than about 99 wt. % of water.

Lubricant compositions of the present invention can be applied as is or may be diluted before use. It may be desirable to provide compositions of the present invention in the form of concentrates that can be diluted with water at the point of use to give use compositions. If diluted, preferred ratios for dilution at the point of use range from about 1:100 to 1:1000 (parts of concentrate: parts of water). In the case that lubricant compositions are provided in the form of concentrates, it is particularly preferred to select silicone materials and wetting agents that form stable compositions at 100 to 1000 times the concentration of the use composition.

In the case that the silicone material is a silicone emulsion, the wetting agent or agents preferably are selected from those that will not cause the silicone emulsion to coagulate or separate, either in the use composition or in the concentrate if the composition is provided in the form of a concentrate.

The lubricant compositions can contain functional ingredients if desired. For example, the compositions can contain hydrophilic diluents, antimicrobial agents, stabilizing/coupling agents, detergents and dispersing agents, anti-wear agents, viscosity modifiers, sequestrants, corrosion inhibitors, film forming materials, antioxidants or antistatic agents.

The amounts and types of such additional components will be apparent to those skilled in the art.

Water-Miscible Lubricants

A variety of water-miscible lubricants can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable water-miscible lubricants include phosphate esters, amines and their derivatives, and other commercially available water-miscible lubricants that will be familiar to those skilled in the art. Derivatives (e.g., partial esters or ethoxylates) of the above lubricants can also be employed. For applications involving plastic containers, care should be taken to avoid the use of water-miscible lubricants that might promote environmental stress cracking in plastic containers when evaluated using the PET Stress Crack Test set out below. Preferably the water-miscible lubricant is a polyol such as glycerol or a linear copolymer of ethylene and propylene oxides.

Hydrophilic Diluents

Suitable hydrophilic diluents include alcohols such as isopropyl alcohol, polyols such as ethylene glycol and glycerine, ketones such as methyl ethyl ketone, and cyclic ethers such as tetrahydrofuran. For applications involving plastic containers, care should be taken to avoid the use of hydrophilic diluents that might promote environmental stress cracking in plastic containers when evaluated using the PET Stress Crack Test set out below.

Antimicrobial Agents

Anti-microbial agents can also be added. Some useful antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines and halogens including iodine and chlorine compounds. The antimicrobial agents can be used in amounts to provide the desired antimicrobial properties. In some examples, the amount can range from 0 to about 20 wt.-% of the total composition. hydrophilic Stabilizing/Coupling Agents In a lubricant concentrate, stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like. The stabilizing/coupling agents can be used in an amount to give desired results. This amount can range, for example, from about 0 to about 30 wt.-% of the total composition.

Detergents/Dispersing Agents

Detergents of dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis(2-hydroxyethyl)amine, polyoxyethylene(5-)coco amine, polyoxyethylene(15)coco amine, tallow bis(-2hydroxyethyl)amine, polyoxyethylene(15) amine, polyoxyethylene(5)oleyl amine and the like.

The detergent and/or dispersants can be used in an amount to give desired results. This amount can range, for example, from about 0 to about 30 wt.-% of the total composition.

Anti-Wear Agents

Anti-wear agents can also be added. Some examples of anti-wear agents include zinc dialkyl dithiophosphates, tricresyl phosphate, and alkyl and aryl disulfides and polysulfides. The anti-wear and/or extreme pressure agents are used in amounts to give the desired results. This amount can range, for example, from 0 to about 20 wt.-% of the total composition.

Viscosity Modifiers

Viscosity modifiers can also be used. Some examples of viscosity modifiers include pour-point depressants and viscosity improvers, such as polymethacrylates, polyisobutylenes polyacrylamides, polyvinyl alcohols, polyacrylic acids, high molecular weight polyoxyethylenes, and polyalkyl styrenes. The modifiers can be used in amounts to provide the desired results. In some embodiments, the viscosity modifiers can range for 0 to about 30 wt.-% of the total composition.

Sequestrants

In addition to the aforementioned ingredients, it is possible to include other chemicals in the lubricant concentrates. For example, where soft water is unavailable and hard water is used for the dilution of the lubricant concentrate, there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Corrosion Inhibitors

Useful corrosion inhibitors include polycarboxylic acids such as short chain carboxylic diacids, triacids, as well as phosphate esters and combinations thereof. Useful phosphate esters include alkyl phosphate esters, monoalkyl aryl phosphate esters, dialkyl aryl phosphate esters, trialkyl aryl phosphate esters, and mixtures thereof such as Emphos PS 236 commercially available from Witco Chemical Company. Other useful corrosion inhibitors include the triazoles, such as benzotriazole, tolyltriazole and mercaptobenzothiazole, and in combinations with phosphonates such as 1-hydroxyethylidene-1,1-diphosphonic acid, and surfactants such as oleic acid diethanolamide and sodium cocoamphohydroxy propyl sulfonate, and the like. Useful corrosion inhibitors include polycarboxylic acids such as dicarboxylic acids. The acids which are preferred include adipic, glutaric, succinic, and mixtures thereof. The most preferred is a mixture of adipic, glutaric and succinic acid, which is a raw material sold by BASF under the name SOKALAN™ DCS.

Preferred lubricant compositions may also contain a stoichiometric amount of an organic acid. Lubricant compositions that comprise a stoichiometric amount of an organic acid and have improved compatibility with PET are disclosed in assignee's copending patent application, titled SILICONE CONVEYOR LUBRICANT WITH STOICHIOMETRIC AMOUNT OF AN ORGANIC ACID, filed Sep. 22, 2005, which application is incorporated herein by reference. Compositions which comprise both a stoichiometric amount of acid and wetting agent sufficient to lower the contact angle to less than about 60 degrees may exhibit a synergistic effect, that is, the overall reduction of the failure rate for PET bottles may be greater than the sum of the reduction of the failure rate for either a stoichiometric amount of acid or wetting agent alone.

Preferred lubricant compositions may be foaming, that is, they may have a foam profile value greater than about 1.1 when measured using a Foam Profile Test. Conveyor lubricants that contain silicone and foam are heretofore unknown. Lubricant compositions which exhibit foam profile values greater than about 1.1 may be advantageous because they offer a visual indication of the presence of lubricant, because foam allows movement of lubricant to areas of the conveyor that are not wetted directly by nozzles, brushes, or other means of application, and because foam enhances contact of the lubricant composition with the package being conveyed. Lubricant compositions preferably have a foam profile value that is greater than about 1.1, more preferably greater than about 1.3, and most preferably greater than about 1.5, when evaluated using the Foam Profile Test described below.

The lubricant compositions preferably create a coefficient of friction (COF) that is less than about 0.20, more preferably less than about 0.15, and most preferably less than about 0.12, when evaluated using the Short Track Conveyor Test described below.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRA-PACK™ boxes), cans, bottles and the like; Although any desired portion of the container can be coated with the lubricant composition, the lubricant composition preferably is applied only to parts of the container that will come into contact with the conveyor or with other containers. For some such applications the lubricant composition preferably is applied to the conveyor rather than to the container.

The lubricant composition can be a liquid or semi-solid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition.

Methods of Application

The lubricant coating can be applied in a constant or intermittent fashion. Preferably, the lubricant coating is applied in an intermittent fashion in order to minimize the amount of applied lubricant composition. It has been discovered that the compositions of the present invention may be applied intermittently and maintain a low coefficient of friction in between applications, or avoid a condition known as "drying". Specifically, compositions of the present invention may be applied for a period of time and then not applied for at least 15 minutes, at least 30 minutes, or at least 120 minutes or longer. The application period may be long enough to spread the composition over the conveyor belt (i.e. one revolution of the conveyor belt). During the application period, the actual application may be continuous, i.e. lubricant is applied to the entire conveyor, or intermittent, i.e. lubricant is applied in bands and the containers spread the lubricant around. The lubricant is preferably applied to the conveyor surface at a location that is not populated by packages or containers. For example, it is preferable to apply the lubricant spray upstream of the package or container flow or on the inverted conveyor surface moving underneath and upstream of the container or package.

In some embodiments, the ratio of application time to non-application time may be 1:10, 1:30, 1:180, and 1:500 where the lubricant maintains a low coefficient of friction in between lubricant applications.

In some embodiments, the lubricant maintains a coefficient of friction below about 0.2, below about 0.15, and below about 0.12.

In some embodiments, a feedback loop may be used to determine when the coefficient of friction reaches an unacceptably high level. The feedback loop may trigger the lubricant composition to turn on for a period of time and then optionally turn the lubricant composition off when the coefficient of friction returns to an acceptable level.

The lubricant coating thickness preferably is maintained at least about 0.0001 mm, more preferably about 0.001 to about 2 mm, and most preferably about 0.005 to about 0.5 mm.

Application of the lubricant composition can be carried out using any suitable technique including spraying, wiping, brushing, drip coating, roll coating, and other methods for application of a thin film.

The lubricant compositions can if desired be evaluated using a Contact Angle Measurement Test, a Surface Tension Test, a Coating Test, a Short Track Conveyor Test, a Foam Profile Test, and a PET Stress Crack Test.

Contact Angle Measurement Test

For the present invention, the contact angle of lubricant use compositions was measured using an FTÅ 200 Dynamic Contact Angle Analyzer available from First Ten Angstroms, Portsmouth, Va. A droplet of use composition was applied to Melinex 516 uncoated polyethylene terephthalate film using a 1 inch 22 gauge needle and the contact angle measured 10 seconds after applying the drop to the film. Melinex 516 film is a product of Dupont Teijin Films and is available in sheets from GE Polymershapes, Huntersville, N.C.

Surface Tension Test

The surface tension of lubricant compositions was measured using a K12 Microbalance Surface Tensiometer available from Krüss USA, Charlotte, N.C. According to this method, the surface tension force resisting advancement of a platinum Wilhelmy plate into a sample of the conveyor lubricant mixture was measured directly and the surface tension is reported mN/m (equivalent to dyne/cm).

Coating Test

A wet coating of lubricant composition was prepared by pipetting approximately 4 mL of lubricant composition onto an approximately 90 square inch sample of Melinex 516 uncoated polyethylene terephthalate film and spreading the puddle across the film surface by hand using a number 6 Mayer bar (available from RD Specialties, Webster N.Y.). The thickness of the wet coating was approximately 14 microns. The wet film was observed for wetting properties and defects in the wet coating including beading up and localized de-wetting. The coating was allowed to dry under ambient conditions and the properties of the dried film noted including contiguity and percent surface coverage.

Short Track Conveyor Test

A conveyor system employing a motor-driven 83 mm wide by 6.1 meter long REXNORD™ LF polyacetal thermoplastic conveyor belt was operated at a belt speed of 30.48 meters/minute. Four 20 ounce filled PET beverage bottles were lassoed and connected to a stationary strain gauge. The force exerted on the strain gauge during belt operation was recorded using a computer. A thin, even coat of the lubricant composition was applied to the surface of the belt using conventional lubricant spray nozzles which apply a total of 4 gallons of lubricant composition per hour. The belt was allowed to run for 25 to 90 minutes during which time a consistently low drag force was observed. The coefficient of friction (COF) was calculated by dividing the drag force (F) by the weight of the four 20 ounce filled PET beverage bottles (W): COF=F/W.

Foam Profile Test

According to this test, 200 mL of room temperature lubricant composition in a stoppered 500 mL glass graduated cylinder was inverted 10 times. Immediately after the tenth inversion, the total volume of liquid plus foam was recorded. The stoppered cylinder was allowed to remain stationary, and 60 seconds after the last inversion of the cylinder the total volume of liquid plus foam was recorded. The foam profile value is the ratio of the total volume of liquid plus foam at 60 seconds divided by the original volume.

PET Stress Crack Test

Compatibility of lubricant compositions with PET beverage bottles was determined by charging bottles with carbonated water, contacting with lubricant composition, storing at elevated temperatures and humidity for a period of 28 days, and counting the number of bottles that either burst or leaked through cracks in the base portion of the bottle. Standard twenty ounce "Global Swirl" bottles (available from Constar International) were charged successively with 658 g of chilled water at 0 to 5 C, 10.6 g of citric acid, and 10.6 g of sodium bicarbonate. Immediately after addition of sodium bicarbonate, the charged bottle was capped, rinsed with deionized water and stored at ambient conditions (20-25 C) overnight. Twenty four bottles thus charged were dipped in lubricant working composition up to the seam which separates the base and sidewall portions of the bottle and swirled for approximately five seconds, then placed in a standard bus pan (part number 4034039, available from Sysco, Houston Tex.) lined with a polyethylene bag. Additional lubricant working composition was poured into the bus pan around the bottles so that the total amount of lubricant composition in the pan (carried in on bottles and poured in separately) was equal to 132 g. The lubricant composition was not foamed for this test. For each lubricant tested, a total of four bus pans of 24 bottles were used. Immediately after placing bottles and lubricant into bus pans, the bus pans were removed to a humidity chamber under conditions of 100 F and 85% relative humidity. Bins were checked on a daily basis and number of failed bottles (burst or leak of liquid through cracks in the bottle base) was recorded. At the end of 28 days, the amount of crazing on the base region of bottles that did not fail during humidity testing was evaluated. A visual crazing score was given to bottles where 0=no crazing is evident, the bottle base remains clear; and 10=pronounced crazing to the extent that the base has become opaque.

EXAMPLES

The invention can be better understood by reviewing the following examples. The examples are for illustration purposes only, and do not limit the scope of the invention.

Comparative Example A

Deionized Water with 200 ppm Added Alkalinity

A solution of deionized water containing 200 ppm alkalinity as $CaCO_3$ was prepared by dissolving 0.336 g of sodium bicarbonate in 1000 g of deionized water. The contact angle of the solution on PET film was determined to be 67 degrees. The wetting behavior of the solution was evaluated by the coating test described above. Upon coating, the solution beaded up immediately giving isolated drops which dried to give water spots which covered approximately 5% of the film surface. The foam profile value for the solution measured as described above was 1.0. The alkaline water solution was tested for PET compatibility as described above. After 28 days of storage under conditions of 100 F and 85% relative humidity, 20 of 96 bottles had failed (21%). The visual crazing score for the unfailed bottles in this test was 1.7.

Comparative Example B

Silicone Lubricant

A solution of deionized water containing 2000 ppm alkalinity as $CaCO_3$ was prepared by dissolving 3.36 g of sodium bicarbonate in 1000 g of deionized water. A lubricant composition was prepared by adding 5.0 g of a 10% dilution of Lambent E2140FG silicone emulsion with water and 200 g of 2000 ppm alkaline water to 1795 g of deionized water. The lubricant composition contained 250 ppm Lambent E2140FG silicone emulsion and 336 ppm sodium bicarbonate (equivalent to 200 ppm alkalinity as $CaCO_3$). The contact angle of the lubricant composition on PET film was determined to be 64 degrees, and the surface tension of the composition was 38.7 dynes/cm. The wetting behavior of the lubricant composition was evaluated by the coating test described above. Upon coating, the composition beaded up immediately giving isolated drops which dried to give water spots which covered approximately 5% of the film surface. The foam profile value for the composition measured as described above was 1.0. The silicone lubricant composition was tested for PET compatibility whereupon after 28 days of storage under conditions of 100 F and 85% relative humidity, 22 of 96 bottles had failed (23%). The visual crazing score for the unfailed bottles in this test was 2.1. What this comparative example shows is that addition of silicone lubricant to alkaline water does not cause a significant change in the proportion of failed bottles in the PET compatibility test relative to alkaline water alone.

Example 1

Silicone Lubricant Plus Alcohol Ethoxylate Wetting Agent

A lubricant composition was prepared by adding 8.0 g of a 10% aqueous solution of Surfonic L 24-7 surfactant (available from Huntsman Chemical, Houston Tex.) to 992 g of the silicone lubricant composition of Comparative Example B. The lubricant composition contained 248 ppm Lambent E2140FG silicone emulsion, 800 ppm of Surfonic L 24-7, and 333 ppm sodium bicarbonate (equivalent to 200 ppm alkalinity as $CaCO_3$). The contact angle of the lubricant composition on PET film was determined to be 24 degrees, and the surface tension of the composition was 28.3 dynes/cm. The wetting behavior of the lubricant composition was evaluated by the coating test described above. Upon coating, the composition gave a uniform film with approximately 10 pin head size spots where the liquid had partially de wet the surface. When dried, the coating was slightly hazy, with about 16 spots about 1 cm in diameter where the composition had partially de wet the film. Around each defect was a diffuse hazy halo. The dried coating covered approximately 95% of the surface. The foam profile value for the composition measured as described above was 1.9. The silicone plus alcohol ethoxylate composition lubricant was tested for PET compatibility whereupon after 28 days of storage under conditions of 100 F and 85% relative humidity, 14 of 96 bottles had failed (15%). The visual crazing score for the unfailed bottles in this test was 6.8. What this example shows is that addition of an alcohol ethoxylate wetting agent to a silicone lube improves the wetting of the lubricant composition to a PET surface and gives a reduction in the failure rate of bottles in the PET compatibility test compared to a silicone lubricant without wetting agent.

Example 2

Silicone Lubricant Plus Silicone Wetting Agent

A lubricant composition was prepared by adding 5.2 g of a 10% aqueous solution of Silwet L-77 surfactant (available from GE Silicones, Friendly, W. Va.) to 1000 g of the silicone lubricant composition of Comparative Example B. The lubricant composition contained 249 ppm Lambent E2140FG silicone emulsion, 517 ppm of Silwet L-77, and 334 ppm sodium bicarbonate (equivalent to 200 ppm alkalinity as $CaCO_3$). The contact angle of the lubricant composition on PET film was determined to be 49 degrees. The surface tension of the composition was 23.6 dynes/cm. The wetting behavior of the lubricant composition was evaluated by the coating test described above. Upon coating, the composition gave a film with approximately 100 spots of about 0.5 cm diameter where the liquid had de wet the surface. When dried, the coating was hazy, with about 100 de wet spots about 0.7 cm in diameter. Around each defect was a diffuse hazy halo. The dried coating covered approximately 50% of the surface. The foam profile value for the composition measured as described above was 1.1. The silicone plus silicone wetting agent lubricant composition was tested for PET compatibility whereupon after 28 days of storage under conditions of 100 F and 85% relative humidity, 14 of 96 bottles had failed (15%). The visual crazing score for the unfailed bottles in this test was 6.3. What this example shows is that addition of a silicone surfactant wetting agent to a silicone lube improves the wetting of the lubricant composition to a PET surface and gives a reduction in the failure rate of bottles in the PET compatibility test compared to a silicone lubricant without wetting agent.

Example 3

Silicone Lubricant Plus Nonyl Phenol Ethoxylate Wetting Agent

A lubricant composition was prepared by adding 8.0 g of a 10% aqueous solution of Surfonic N95 surfactant (available from Huntsman Chemical, Houston Tex.) to 992 g of the silicone lubricant composition of Comparative Example B. The lubricant composition contained 249 ppm Lambent E2140FG silicone emulsion, 800 ppm of Silwet L-77, and 334 ppm sodium bicarbonate (equivalent to 200 ppm alkalinity as $CaCO_3$). The contact angle of the lubricant composition on PET film was determined to be 15 degrees. The surface tension of the composition was 42.4 dynes/cm. The wetting behavior of the lubricant composition was evaluated by the coating test described above. Upon coating, the composition gave a substantially uniform film with no defects or de wet spots. When dried, the coating was slightly hazy, with non-uniform gradations of haziness. The dried coating covered approximately 99% of the surface. The foam profile value for the composition measured as described above was 1.8. The silicone plus nonyl phenol ethoxylate wetting agent lubricant composition was tested for PET compatibility whereupon after 28 days of storage under conditions of 100 F C and 85% relative humidity, 10 of 96 bottles had failed (10%). The visual crazing score for the unfailed bottles in this test was 7.8. What this example shows is that addition of a nonyl phenol ethoxylate wetting agent to a silicone lube improves the wetting of the lubricant composition to a PET surface and gives a reduction in the failure rate of bottles in the PET compatibility test compared to a silicone lubricant without wetting agent.

Example 4

Silicone Lubricant Plus Fatty Amine Plus Alcohol Ethoxylate Wetting Agent

An acidified fatty amine solution was prepared by adding 29 g of glacial acetic acid and 80.0 g of Duomeen OL (available from Akzo Nobel Surface Chemistry LLC, Chicago, Ill.) to 691 g of deionized water. A lubricant concentrate composition was prepared by adding 15 g of Lambent E2140FG silicone emulsion, 24 g of Surfonic L 24-7 surfactant, and 150 g of acidified fatty amine solution to 111 g of deionized water. A lubricant composition was prepared by adding 5.0 g of the lubricant concentrate composition to a solution of 0.336 g of sodium bicarbonate in 1000 g of deionized water. The lubricant composition contained 250 ppm Lambent E2140FG silicone emulsion, 250 ppm of Duomeen OL, 400 ppm of Surfonic L 24-7, and 336 ppm sodium bicarbonate (equivalent to 200 ppm alkalinity as $CaCO_3$). The contact angle of the lubricant composition on PET film was determined to be 32 degrees. The surface tension of the composition was 28.0 dynes/cm. The wetting behavior of the lubricant composition was evaluated by the coating test described above. Upon coating, the composition gave a film with approximately 50 pencil eraser size de wet spots which dried to give an imperfect film which covered approximately 80% of the PET surface. The foam profile value for the composition measured as described above was 1.8. The lubricant composition was tested for PET compatibility as described above whereupon after 28 days of storage under conditions of 100 F and 85% relative humidity, 7 of 96 bottles had failed (7%). The visual crazing score for the unfailed bottles in this test was 4.1. What this example shows is that addition of a wetting agent comprising a mixture of acidified fatty amine and alcohol ethoxylate compounds to a silicone lube improves the wetting of the lubricant composition to a PET surface and gives a reduction in the failure rate of bottles in the PET compatibility test compared to a silicone lubricant without wetting agent.

Comparative Example C

Deionized Water with 100 ppm Added Alkalinity

A solution of deionized water containing 100 ppm alkalinity as $CaCO_3$ was prepared by dissolving 0.168 g of sodium bicarbonate in 1000 g of deionized water. The wetting behavior of the solution was evaluated by the coating test described above. Upon coating, the solution beaded up immediately giving isolated drops which dried to give water spots which covered approximately 5% of the film surface. The alkaline water solution was tested for PET compatibility as described above. After 28 days of storage under conditions of 100 F and 85% relative humidity, 19 of 120 bottles had failed (16%). The visual crazing score for the unfailed bottles in this test was 1.4.

Comparative Example D

Silicone Plus Water-Miscible Lubricant

A lubricant composition was prepared which contained 125 ppm Lambent E2140FG silicone emulsion, 7.5 ppm Pluronic F108 poly(ethylene oxide-propylene oxide) block copolymer, 5.0 ppm methyl paraben, and 168 ppm sodium bicarbonate (equivalent to 100 ppm alkalinity as $CaCO_3$). The contact angle of the lubricant composition on PET film was determined to be 64 degrees. The wetting behavior of the lubricant composition was evaluated by the coating test described above. Upon coating, the composition beaded up immediately giving isolated drops which dried to give water spots which covered approximately 5% of the film surface. The silicone plus water-miscible lubricant composition was tested for PET compatibility whereupon after 28 days of storage under conditions of 100 F and 85% relative humidity, 9 of 48 bottles had failed (19%). What this comparative example shows is that addition of a composition of silicone plus water-miscible lubricant to alkaline water does not cause a significant improvement in wetting of the composition to a PET surface and does not cause a significant improvement in the proportion of failed bottles in the PET compatibility test relative to alkaline water alone.

Comparative Example E

Commercial Silicone Lubricant

A commercial lubricant composition was prepared which contained 2500 ppm of Dicolube TPB (product of Johnson Diversey) and 168 ppm sodium bicarbonate (equivalent to 100 ppm alkalinity as $CaCO_3$). The contact angle of the lubricant composition on PET film was determined to be 72 degrees. The wetting behavior of the lubricant composition was evaluated by the coating test described above. Upon coating, the composition beaded up immediately giving isolated drops which dried to give water spots which covered less than 5% of the film surface. The commercial lubricant composition was tested for PET compatibility whereupon after 28 days of storage under conditions of 100 F and 85% relative humidity, 7 of 48 bottles had failed (15%). What this comparative example shows is that addition of a composition of a commercial silicone lubricant to alkaline water does not cause a significant improvement in wetting of the composition to a PET surface and does not cause a significant improvement in the proportion of failed bottles in the PET compatibility test relative to alkaline water alone.

Example 5

Silicone Lubricant Plus Fatty Amine Plus Alcohol Ethoxylate Wetting Agent

An acidified fatty amine solution was prepared by adding 29 g of glacial acetic acid and 80.0 g of Duomeen OL (available from Akzo Nobel Surface Chemistry LLC, Chicago, Ill.) to 691 g of deionized water. A lubricant concentrate composition was prepared by adding 25.0 g of acidified fatty amine composition, 8.0 g of Surfonic L 24-7 surfactant, and 2.5 g of Dow Corning HV-490 silicone emulsion to 64.5 g of deionized water. A lubricant composition was prepared by adding 5.0 g of the lubricant concentrate composition to a solution of 0.168 g of sodium bicarbonate in 1000 g of deionized water. The lubricant composition contained 125 ppm Dow Corning HV-490 silicone emulsion, 125 ppm of Duomeen OL, 400 ppm of Surfonic L 24-7, and 168 ppm sodium bicarbonate (equivalent to 100 ppm alkalinity as $CaCO_3$). The contact angle of the lubricant composition on PET film was determined to be 29 degrees. The wetting behavior of the lubricant composition was evaluated by the coating test described above. Upon coating, the composition gave a continuous coating with about 40 de wet areas about 0.5 to 1 cm in diameter. The wet coating covered about 80-90% of the PET surface. Upon drying, the composition gave a substantially continuous film which covered approximately 70% of the PET surface. The foam profile value for the composition measured as described above was 1.8. The lubricant composition was tested for PET compatibility as described above whereupon after 28 days of storage under conditions of 100 F and 85% relative humidity, 9 of 96 bottles had failed (9%). The visual crazing score for the unfailed bottles in this test was 7.5. What this example shows is that addition of a composition of a wetting agent comprising a mixture of acidified fatty amine and alcohol ethoxylate compounds to a silicone lubricant causes an improvement in wetting of the composition to a PET surface and an improvement in the proportion of failed bottles in the PET compatibility test relative to a silicone plus water-miscible lubricant composition.

Example 6

Silicone Lubricant Plus Citric Acid/Sodium Citrate Plus Alcohol Ethoxylate Wetting Agent A lubricant concentrate composition was prepared by adding 2.5 g of Dow Corning HV-490 silicone emulsion, 7.0 g citric acid, 2.1 g of a 50% solution of NaOH, 2.0 g of Tomadol 91-8 alcohol ethoxylate, and 2.85 g of a 35% solution of $H_2O_2$ to 83.6 g deionized water. A lubricant composition was prepared by diluting 1.0 g of the lubricant concentrate composition with 399 g of a solution of 168 ppm sodium bicarbonate in deionized water. The resulting lubricant composition contained 63 ppm Dow Corning HV-490 silicone emulsion, 175 ppm citric acid, 26 ppm NaOH, 50 ppm Tomadol 91-8 alcohol ethoxylate, 25 ppm $H_2O_2$, and 168 ppm sodium bicarbonate (equivalent to 100 ppm alkalinity as $CaCO_3$). The ratio of unneutralized acid equivalents from the lubricant concentrate composition to equivalents of base from the alkaline water was 1.00 to 1.00. The pH of the lubricant composition was 5.94. The contact angle of the lubricant composition on PET film was determined to be 58 degrees. The wetting behavior of the lubricant composition was evaluated by the coating test described above. Upon coating, the composition beaded up immediately and dried to give spots which covered less than 5% of the PET surface. The foam profile value for the composition measured as described above was 1.3. The silicone lubricant composition was tested for PET compatibility as described, except that 20 oz "Contour" bottles available from Southeastern Container Corp. (Enka, N.C.) were substituted for 20 ounce "Global Swirl" bottles. After 28 days of storage under conditions of 100 F and 85% relative humidity, 1 of 96 bottles had failed (1%). The crazing score for the unfailed bottles in this test was 3.4. What this example shows is that including approximately one equivalent of unneutralized acid for every equivalent of alkalinity in lube dilution water and decreasing the contact angle of the lubricant composition to less than about 60 degrees is capable to reduce the failure rate of bottles in the PET compatibility test relative to a silicone plus water-miscible lubricant composition. In a separate test, 20 g of the lubricant concentrate composition was diluted with 10 Kg of city water and the coefficient of friction using the Short Track Conveyor Test described above. The coefficient of friction between 4 20 ounce "Global Swirl" bottles and Delrin track was 0.11.

Example 7

Silicone Lubricant Plus Fatty Amine Plus Alcohol Ethoxylate Wetting Agent Plus Lactic Acid An acidified fatty amine solution was prepared by adding 29 g of glacial acetic acid and 80.0 g of Duomeen OL (available from Akzo Nobel Surface Chemistry LLC, Chicago, Ill.) to 691 g of deionized water. A lubricant concentrate composition was prepared by adding 25.0 g of acidified fatty amine solution, 8.0 g of Surfonic L 24-7 surfactant, 6.5 g of 88% lactic acid, and 2.5 g of Lambent E2140FG silicone emulsion to 58.0 g of deionized water. A lubricant composition was prepared by adding 5.0 g of the lubricant concentrate composition to a solution of 0.168 g of sodium bicarbonate in 1000 g of deionized water. The lubricant composition contained 125 ppm Lambent E2140FG silicone emulsion, 125 ppm of Duomeen OL, 400 ppm of Surfonic L 24-7, 286 ppm lactic acid, and 168 ppm sodium bicarbonate (equivalent to 100 ppm alkalinity as $CaCO_3$). The contact angle of the lubricant composition on PET film was determined to be 39 degrees. The wetting behavior of the lubricant composition was evaluated by the coating test described above. Upon coating, the composition gave a film with approximately 30 pencil eraser size de wet spots which dried to give an imperfect film which covered approximately 75% of the PET surface. The foam profile value for the composition measured as described above was 1.7. The lubricant composition was tested for PET compatibility as described, except that 20 oz "Contour" bottles available from Southeastern Container Corp. (Enka, N.C.) were substituted for 20 ounce "Global Swirl" bottles. After 28 days of storage under conditions of 100 F and 85% relative humidity, 0 of 96 bottles had failed (0%). The visual crazing score for the unfailed bottles in this test was 7.6. What this example shows is that addition of a wetting agent comprising a mixture of acidified fatty amine and alcohol ethoxylate compounds and a stoichiometric amount of organic acid to a silicone lubricant composition causes an improvement in wetting of the composition to a PET surface and an improvement in the proportion of failed bottles in the PET compatibility test relative to a silicone plus water-miscible lubricant composition.

Examples 8-14 and Comparative Examples F-I

Twelve lubricant formulations were prepared according to the formulas of Table 1. These lubricant compositions were evaluated using the Contact Angle Measurement Test, the Coating Test, and the Foam Profile Test. Comparative Examples F, G, H and I have poor wetting to PET film, generally exhibiting contact angles greater than about 60 degrees using the Contact Angle Measurement Test and areal coverages less than about 30% using the Coating Test. Examples 8-14 (Invention) show good wetting, generally exhibiting contact angles less than about 60 degrees using the Contact Angle Measurement Test and areal coverages greater than about 30% using the Coating Test.

TABLE 1

| | Example F (Comp.) | Example G (Comp.) | Example H (Comp.) | Example I (Comp.) | Example 7 | Example 8 |
|---|---|---|---|---|---|---|
| Sodium Bicarbonate | 168 | 334 | 334 | 334 | 331 | 331 |
| Lambent E2140FG | 125 | | | | | |
| Dicolube TPB | | 5000 | | | 5000 | |

TABLE 1-continued

| | | | | | | |
|---|---|---|---|---|---|---|
| Lubodrive FP | | | 5000 | | | 5000 |
| Composition of Example 2 from U.S. Pat. No. 6,495,494 | | | | 5000 | | |
| Surfonic L 24-7 | | | | | 800 | 800 |
| Rhodafac RA-600 | | | | | | |
| NaOH | | | | | | |
| Barlox 12 (30% lauryl dimethyl amine N-oxide) | | | | | | |
| Glucopon 425 N (50% alklyl polyglucoside) | | | | | | |
| Tomadol 91-8 | | | | | | |
| Antarox BL-240 | | | | | | |
| 4 g of 8% Tomah PA-1618 | | | | | | |
| contact angle | 68 | 69 | 64 | 70 | 22 | 22 |
| wet coating coverage | <5% | <5% | <5% | <5% | about 100% | about 100% |
| dry coating coverage | <5% | <5% | <5% | <5% | >99% | about 95% |
| foam profile value | 1.0 | 1.0 | 1.0 | 1.0 | 1.6 | 1.6 |

| | Example 9 | Example 10 | Example 11 | Example 12 | Example 13 | Example 14 |
|---|---|---|---|---|---|---|
| Sodium Bicarbonate | 331 | 332 | 332 | 332 | 329 | 332 |
| Lambent E2140FG | | 125 | 125 | 125 | 124 | 125 |
| Dicolube TPB | | | | | | |
| Lubodrive FP | | | | | | |
| Composition of Example 2 from U.S. Pat. No. 6,495,494 | 5000 | | | | | |
| Surfonic L 24-7 | 800 | | | | | |
| Rhodafac RA-600 | | 800 | | | | |
| NaOH | | 130 | | | | |
| Barlox 12 (30% lauryl dimethyl amine N-oxide) | | | 3750 | | | |
| Glucopon 425 N (50% alklyl polyglucoside) | | | | 1600 | | |
| Tomadol 91-8 | | | | | 792 | |
| Antarox BL-240 | | | | | 792 | |
| 4 g of 8% Tomah PA-1618 | | | | | | 800 |
| contact angle | 25 | 41 | 37 | 32 | 19 | 21 |
| wet coating coverage | about 100% | about 100% | about 100% | about 90% | about 100% | about 50% |
| dry coating coverage | about 95% | about 95% | about 95% | about 80% | about 80% | about 30% |
| foam profile value | 1.8 | 1.9 | 2.0 | 1.6 | 1.3 | 1.3 |

Various modifications and alterations of this invention will be apparent to those skilled in the art without departing from the scope and spirit of the invention, and are intended to be within the scope of the following claims.

What is claimed is:

1. A method for lubricating the passage of a container along a conveyor, comprising applying an aqueous, phase-stable lubricant composition to at least a portion of the container—contacting surface of the conveyor, the aqueous, phase-stable lubricant composition comprising from about 0.0005 wt. % to about 5.0 wt. % of a water-miscible silicone material; and from about 0.01 wt. % to about 0.50 wt. % of at least one wetting agent selected from the group consisting of fatty amine, alcohol ethoxylate, and mixtures thereof;

wherein the lubricant composition directly contacts the container, the lubricant composition forms a substantially contiguous coating which covers greater than 30% of the surface when coated and dried onto polyethylene terephthalate film, the contact angle between the lubricant composition and container is less than about 60 degrees.

2. The method of claim 1, wherein the silicone material is selected from the group consisting of silicone emulsion, finely divided silicone powder, and silicone surfactant.

3. The method of claim 1, wherein the lubricant composition further comprises one or more functional ingredients selected from the group of water-miscible lubricants, hydrophilic diluents, antimicrobial agents, stabilizing/coupling agents, detergents/dispersing agents, anti-wear agents, viscosity modifiers, sequestrants, corrosion inhibitors, and mixtures thereof.

4. The method of claim 1, wherein the lubricant composition comprises from about 0.002 wt, % to about 0.5 wt, % of a water-miscible silicone material.

5. The method of claim 1, wherein the container comprises one or more polymers selected from the group of polyethylene terephthalate, polyethylene naphthalate, and bisphenol A carbonate.

6. The method of claim 1, wherein the contact angle between the lubricant composition and container is less than about 50 degrees.

7. The method of claim 1, wherein the contact angle between the lubricant composition and container is less than about 40 degrees.

8. The method of claim 1, wherein the lubricant composition is applied for a period of time and off for a period of time and the ratio of applied time to off time is at least 1:1.

9. The method of claim 1, wherein the lubricant composition further comprises from about 0.02 wt, % to about 0.30% of at least one wetting agent.

10. A method for lubricating the passage of a container along a conveyor, comprising applying an aqueous, phase-stable lubricant composition to at least a portion of the container-contacting surface of the conveyor or to at least a portion of the conveyor-contacting surface of the container, the aqueous, phase-stable lubricant composition comprising from about 0.0005% to about 5.0% of a water-miscible silicone material; and from about 0.01 wt. % to about 0.50 wt. % of at least one wetting agent selected from the group consisting of fatty amine, alcohol ethoxylate, and mixtures thereof;

wherein the lubricant composition directly contacts the container, the lubricant composition forms a substantially contiguous coating which covers greater than about 30% of the surface when coated and dried onto polyethylene terephthalate film with a wet coating thickness of about 14 microns.

11. The method of claim 10, wherein the silicone material is selected from the group consisting of silicone emulsion, finely divided silicone powder, and silicone surfactant.

12. The method of claim 10, wherein the lubricant composition further comprises one or more functional ingredients selected from the group of water-miscible lubricants, hydrophilic diluents, antimicrobial agents, stabilizing/coupling agents, detergents/dispersing agents, anti-wear agents, viscosity modifiers, sequestrants, corrosion inhibitors, and mixtures thereof.

13. The method of claim 10, wherein the lubricant composition comprises from about 0.002 wt, % to about 0.5 wt, % of a water-miscible silicone lubricant.

14. The method of claim 10, wherein the container comprises one or more polymers selected from the group of polyethylene terephthalate, polyethylene naphthalate, and bisphenol A carbonate.

15. The method of claim 10, wherein the lubricant composition forms a substantially contiguous coating which covers greater than about 50% of the surface when coated and dried onto polyethylene terephthalate film with a wet coating thickness of about 14 microns.

16. The method of claim 10, wherein the lubricant composition forms a substantially contiguous coating which covers greater than about 70% of the surface when coated and dried onto polyethylene terephthalate film with a wet coating thickness of about 14 microns.

17. The method of claim 10, wherein the lubricant composition is applied for a period of time and off for a period of time and the ratio of applied time to off time is at least 1:1.

18. The method of claim 10, wherein the lubricant composition comprises from about 0.02 wt, % to about 0.30 wt, % of at least one wetting agent.

19. A method for lubricating the passage of a container along a conveyor, comprising applying aqueous, phase-stable lubricant composition to at least a portion of the container-contacting surface of the conveyor or to at least a portion of the conveyor-contacting surface of the container, the aqueous, phase-stable lubricant composition comprising from about 0.0005 wt, % to about 5.0 wt, % of a water-miscible silicone material; and from about 0.01 wt. % to about 0.50 wt. % of at least one wetting agent selected from the group consisting of fatty amine, alcohol ethoxylate, and mixtures thereof;

wherein the lubricant composition directly contacts the container, the foam profile for the composition is greater than about 1.1.

20. The method of claim 19, wherein the silicone material is selected from the group consisting of silicone emulsion, finely divided silicone powder, and silicone surfactant.

21. The method of claim 19, wherein the lubricant composition further comprises one or more functional ingredients selected from the group of water-miscible lubricants, hydrophilic diluents, antimicrobial agents, stabilizing/coupling agents, detergents/dispersing agents, anti-wear agents, viscosity modifiers, sequestrants, corrosion inhibitors and mixtures thereof.

22. The method of claim 19, wherein the lubricant composition comprises from about 0.002 wt. % to about 0.5 wt. % of a water-miscible silicone material.

23. The method of claim 19, wherein the container comprises one or more polymers selected from the group of polyethylene terephthalate, polyethylene naphthalate, and bisphenol A carbonate.

24. The method of claim 19, wherein the foam profile for the composition is greater than about 1.3.

25. The method of claim 19, wherein the foam profile for the composition is greater than about 1.5.

26. The method of claim 19, wherein the lubricant composition is applied for a period of time and off for a period of time and the ratio of applied time to off time is at least 1:1.

27. The method of claim 19, wherein the lubricant composition further comprises from about 0.02 wt. % to about 0.30 wt. % of at least one wetting agent.

28. A method for lubricating the passage of a container along a conveyor, comprising applying an aqueous, phase-stable lubricant composition to at least a portion of the container-contacting surface of the conveyor or to at least a portion of the conveyor-contacting surface of the container, the aqueous, phase-stable lubricant composition comprising from about 0.0005 wt. % to about 5.0 wt. % of a water-miscible silicone material, and from about 0.01 wt. % to about 0.50 wt. % of at least one wetting agent selected from the group consisting of a fatty amine, an alcohol ethoxylate and mixtures thereof, wherein the lubricant composition directly contacts the container, the contact angle between the lubricant composition and container is less than about 60 degrees.

* * * * *